US006775866B1

(12) United States Patent
Martir et al.

(10) Patent No.: US 6,775,866 B1
(45) Date of Patent: Aug. 17, 2004

(54) SAFETY WATERSPOUT

(76) Inventors: Ramón Martir, P.O. Box 335233, Ponce, PR (US) 00733-5233; Julianne Collazo, P.O. Box 335233, Ponce, PR (US) 00733-5233

( * ) Notice: Subject to any disclaimer, the term of this patent is extended or adjusted under 35 U.S.C. 154(b) by 0 days.

(21) Appl. No.: 10/445,647

(22) Filed: May 27, 2003

(51) Int. Cl.[7] ..... E03C 1/04

(52) U.S. Cl. ..... 4/678; 4/675; 239/602

(58) Field of Search ..... 4/675–678; 137/359, 137/801; 239/602

(56) References Cited

U.S. PATENT DOCUMENTS

| | | | | | |
|---|---|---|---|---|---|
| 2,171,023 | A | * | 8/1939 | Buxton | 239/602 |
| 3,707,404 | A | * | 12/1972 | Carlson et al. | 134/10 |
| 3,765,455 | A | * | 10/1973 | Countryman | 137/801 |
| 3,871,406 | A | * | 3/1975 | Anderson | 4/678 |
| 4,084,620 | A | * | 4/1978 | Bucknell et al. | 137/801 |
| 6,067,670 | A | * | 5/2000 | Eddy et al. | 4/575.1 |

* cited by examiner

*Primary Examiner*—Tuan N. Nguyen
(74) *Attorney, Agent, or Firm*—Eugenio J. Torres

(57) ABSTRACT

A safety waterspout is disclosed. The waterspout is made of a soft flexible material to prevent the bather from getting injured when colliding with the waterspout when bathing.

3 Claims, 1 Drawing Sheet

SAFETY WATERSPOUT

STATEMENT REGARDING FEDERALLY SPONSORED RESEARCH AND DEVELOPMENT

N/A

RELATED APPLICATIONS

N/A

BACKGROUND OF THE INVENTION

1. Field of the Invention

The present invention relates generally to a device for use in a bathtub to protect a bathing child or adult from being injured by the waterspout or the water flow control knob or knobs of a bathtub. More specifically, the present invention relates to a device for installing in the bathtub to increase the safety of the bather.

2. Discussion of the Background

A variety of bathtub protection devices and methods are currently known in the prior art. For example, there are inflatable as well as padded devices which surround or encase just the waterspout of a bathtub to protect a user of the bathtub from banging his or her head, arm or some other body part while bathing or when entering into or exiting from the bathtub. However, such protection devices do not fully protect the user from bodily injury from the waterspout. In addition, such protection devices are not designed to cover the water flow control knob or knobs of a bathtub and thus a user still may be injured from banging his or her head, arm or some other body part on the water flow control knob or knobs while bathing or when entering into or exiting from the bathtub. Generally, there are three knobs available in bathtubs or showers. One manages the hot water, one the cold water and the other one the shower.

Various types of safety bathing apparatus are available, including a bath aid providing faucet protection disclosed in U.S. Pat. No. 6,067,670 to Eddy, et al. However, said bath aid has to be secured or attached to the surface or fixture that it will cover. However, none of the devices or methods in the prior art provides a bathing apparatus that is a fixture in the bathtub and does not have to be placed and replaced. In addition, the existing waterspouts and water knobs are made from metal and hard plastic. Such materials represent danger to the bathers when taking a bath. Thus, there is a need for a bathing apparatus that overcomes these and other deficiencies in the prior art. In this respect, the apparatus according to the present invention substantially departs from the conventional concepts and designs of the prior art and, in doing so, provides a safety bathing apparatus that fulfills the aforementioned need.

SUMMARY OF THE INVENTION

The object of the present invention is to provide a bath aid that overcomes the aforementioned problems and drawbacks associated with the prior art bathtub protection devices.

Another object of the present invention is to provide a bath aid which provides protection from both the waterspout and the water control knob or knobs of a bathtub as well as providing comfort to a bather while using the bathtub.

A further object of the present invention is to provide a bath aid which is relatively inexpensive to manufacture and install, while affording safety to a user while bathing.

Yet another object of the present invention is to provide a bath aid which is relatively easy to install in the bathtub.

A still further object of the invention is to provide a bath aid which is relatively soft and flexible, to prevent or minimize injury to a bather during use, and is also resistant to rust and corrosion.

Another object of the present invention is to provide a bath aid which prevents water and soap stains.

Still a further object of the present invention is to provide a bath aid which is resistant to limos.

A still further object of this invention is to provide a bath aid which is adaptable to any faucet.

The present invention relates to a waterspout for use in bathtub, the waterspout comprising a top portion and a bottom portion, and a PVC strength plastic ring thread; wherein said waterspout is made of rubber like material covered by a surface of flexible plastic skin. In turn, said rubber material encloses a flexible house.

The waterspout itself, both as to its construction and its mode of operation, will be best understood, and additional objects and advantages thereof will become apparent, by the following detailed description of a preferred embodiment taken in conjunction with the accompanying drawings.

When the word "invention" is used in this specification, the word "invention" includes "inventions", that is, the plural of "invention". By stating "invention", the Applicant does not in any way admit that the present application does not include more than one patentably and non-obviously distinct invention, and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE PREFERRED EMBODIMENT

Figure 1:
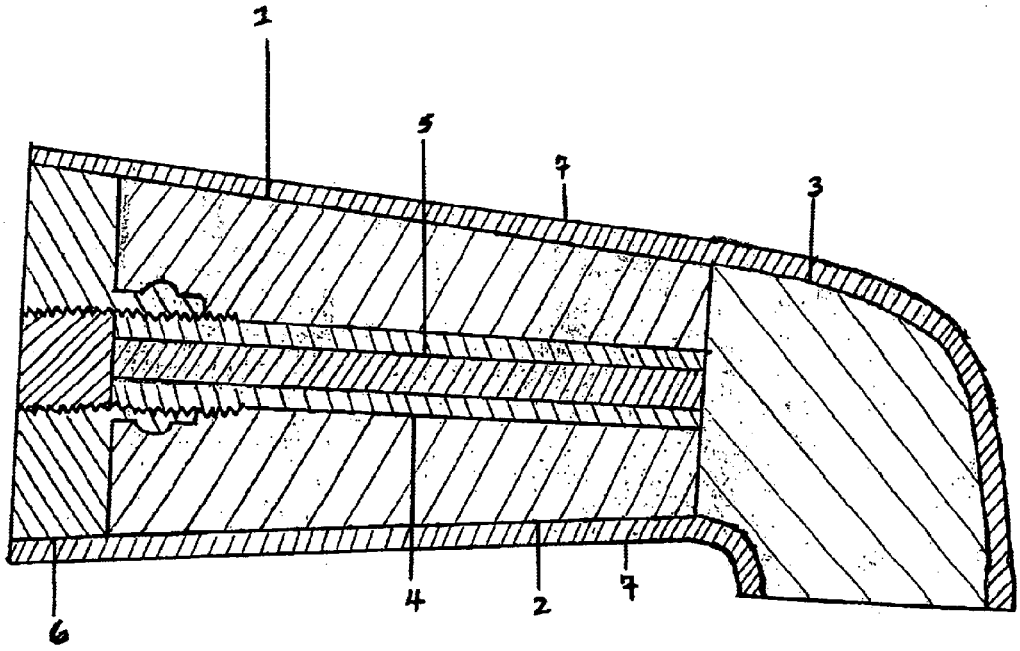
FIG. 1 is a front view of the waterspout of the invention.

Referring now to the drawings, wherein like reference numerals designate the corresponding structure, part, or element, as the case may be, throughout the views, and. particularly to FIG. 1, a waterspout as constructed in accordance with the preferred embodiment of the present invention comprises an elongate body having a top 1 and a bottom 2 portion, and a nose 3 wherein said top portion, said bottom portion, and said nose are made of a flexible material such as soft rubber or another similar material that is soft enough to be flexible, a flexible house embedded in said flexible material such as rubber 4, a flexible tube housed inside said flexible housing 5, and a PVC strength plastic ring thread 6; wherein said top portion, bottom portion, and nose are covered by a surface of flexible plastic skin 7, wherein said flexible housing protects the waterspout from excessively hot or cold temperatures and water flows from said flexible tube. The waterspout also includes a coil made from hard plastic that connects to the bathtub faucet.

The water knobs (not shown on drawings) may also be made from soft rubber. They are sustained with a screw from the middle of each knob to the faucet.

Whenever the bather hits any part of the waterspout or knobs said part will bent and not hurt the bather.

Thus, there has been shown and described a safety bathing apparatus which fulfills all the objects and advantages sought therefor. The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. For example, the particular shapes and proportions of the elements of the waterspout may be varied as desired. Accordingly, all such changes, modifications, variations and other uses and applications that do not depart from the spirit and scope of the invention are deemed to be covered by this invention as defined in the following claims.

All of the patents recited herein, and in the Declaration attached hereto, are hereby incorporated by reference as if set forth in their entirety herein. The details in such patents may be considered to be incorporable at applicant's option, into the claims during prosecution as further limitations in the claims to patentably distinguish any amended claims from any applied prior art.

What is claimed is:

1. A safety waterspout, said safety waterspout comprising:

an elongate body having a top portion, a bottom portion, and a nose;

wherein said top portion, said bottom portion, and said nose are made of a material that is soft enough to be flexible;

a flexible housing embedded in the same flexible material;

a tube housed inside said flexible housing; and a plastic ring thread;

wherein said top portion, said bottom portion, and said nose are covered by a skin of flexible plastic;

wherein said flexible housing protects the safety waterspout from excessively hot or cold temperatures;

wherein water flows from said flexible tube and out of said nose; and wherein said tube is of a short enough length so as not to limit the flexibility of the waterspout.

2. The waterspout of claim 1, wherein said flexible material is rubber.

3. The waterspout of claim 2, further comprising a hard plastic coil that connects to a bathtub faucet.

* * * * *